US009394919B1

(12) United States Patent
Byrne et al.

(10) Patent No.: US 9,394,919 B1
(45) Date of Patent: Jul. 19, 2016

(54) HANGER BRACKET WITH MALE AND FEMALE CONNECTIONS

(71) Applicant: Palm Coast Imports, LLC, Germantown, TN (US)

(72) Inventors: Brendan Byrne, Germantown, TN (US); James Burns, Memphis, TN (US)

(73) Assignee: HKC-US, LLC, Memphis, TN (US)

( * ) Notice: Subject to any disclaimer, the term of this patent is extended or adjusted under 35 U.S.C. 154(b) by 329 days.

(21) Appl. No.: 14/039,218

(22) Filed: Sep. 27, 2013

Related U.S. Application Data

(60) Provisional application No. 61/731,349, filed on Nov. 29, 2012.

(51) Int. Cl.

| | |
|---|---|
| ***F04D 29/64*** | (2006.01) |
| ***F04D 25/06*** | (2006.01) |
| ***F04D 25/08*** | (2006.01) |
| ***F21V 23/00*** | (2015.01) |
| ***F21V 27/00*** | (2006.01) |

(52) U.S. Cl.
CPC ..... *F04D 29/646* (2013.01); *F04D 25/0693* (2013.01); *F04D 25/088* (2013.01); *F21V 23/002* (2013.01); *F21V 27/00* (2013.01)

(58) Field of Classification Search
CPC ..... F04D 25/06; F04D 25/0693; F04D 25/08; F04D 25/088; F04D 29/601; F04D 29/0693; F16M 13/02; F16M 13/027; F21S 8/04; F21S 8/043; F21S 8/036; F21V 23/001; F21V 23/002; F21V 27/00
USPC ..... 248/343; 439/536, 537; 362/147–150, 362/362, 370, 404
See application file for complete search history.

(56) References Cited

U.S. PATENT DOCUMENTS

| | | | | |
|---|---|---|---|---|
| 3,798,584 | A | 3/1974 | Person | |
| 4,721,480 | A | 1/1988 | Yung | |
| 6,036,154 | A * | 3/2000 | Pearce | F04D 25/088 248/343 |
| 6,322,232 | B1 | 11/2001 | Oliver | |
| 6,583,356 | B2 * | 6/2003 | Arthur | H02G 3/185 174/152 G |
| 6,981,679 | B1 * | 1/2006 | Mullen | F21V 21/03 248/342 |
| 7,297,022 | B2 | 11/2007 | Pearce | |
| 7,854,616 | B2 * | 12/2010 | Janos | F21S 2/00 439/76.1 |
| 7,888,597 | B2 * | 2/2011 | Libby, II et al. | H02G 3/125 174/54 |
| 2003/0189151 | A1 | 10/2003 | Hsing | |
| 2008/0181783 | A1 | 7/2008 | Pearce | |

FOREIGN PATENT DOCUMENTS

| | | | |
|---|---|---|---|
| WO | WO 2012097453 A1 * | 7/2012 | H02G 3/16 |

* cited by examiner

*Primary Examiner* — Devon Kramer
*Assistant Examiner* — Chirag Jariwala
(74) *Attorney, Agent, or Firm* — Brian S. Steinberger; Law Offices of Brian S. Steinberger, P.A.

(57) ABSTRACT

Devices, apparatus, systems and methods of hanging ceiling fans and safely making electrical connections between the motor and the mount bracket. The invention allows for the bulky, heavy ceiling fan motor to be left safely on the ground while the wiring from the ceiling box to the mount bracket is done. When the ceiling fan motor is securely hung in the mounting bracket, male and female electrical connectors between the motor and the mounting bracket can be safely interlocked to one another creating a much safer installation over conventional installation techniques.

7 Claims, 7 Drawing Sheets

HANGER BRACKET WITH MALE AND FEMALE CONNECTIONS

CROSS REFERENCE TO RELATED APPLICATIONS

This which claims the benefit of priority to U.S. Provisional Application Ser. No. 61/731,349 filed Nov. 29, 2012, the entire disclosure of which is incorporated herein by specific reference thereto.

FIELD OF INVENTION

This invention relates to hanging ceiling fans, and in particular to devices, apparatus, systems and methods of installing a ceiling fan mounting bracket to a ceiling electrical box, and hanging an end of the motor to the bracket and connecting the wiring from the motor to bracket with male and female electrical connector(s).

BACKGROUND AND PRIOR ART

When hanging a ceiling fan, it is necessary to hardwire the ceiling fan to the home wiring. This installation has generally involved supporting the heaviest part of the fan by hand or by a hanger until the wiring is completed before the fan can be installed, which can be physically dangerous to the installer since the work involves the installer standing on a ladder with their hands holding heavy weights above their head. The wiring often requires the installer to take bare ends of opposite wires which are then twisted together, followed by a wire nut being screwed onto the twisted portions.

Other types of ceiling fan installation has required the ceiling fan motor to be supported by the installer or hung out of the way while the wiring is being done. This type of installation has the heaviest part of the ceiling fan (the motor) by hand "in the way" while the wiring is being completed between the home wiring and the fan. Similarly, wiring is often done by the installer twisting bare ends of wires together followed by twisting a wire nut thereon. Having to connect the wiring on top of a ladder with one hands stretched over one's head can be quite difficult as well as dangerous if the installer should fall.

Additional problems with the prior art is that excess, loose wiring must often be shoved into the canopy/shroud to be moved out of sight that is not easy to do with wiring located above the head of the installer.

Thus, the need exists for solutions to the above problems with the prior art.

SUMMARY OF THE INVENTION

A primary objective of the present invention is to provide devices, apparatus, systems and methods of installing a ceiling fan mounting bracket to a ceiling electrical box, and hanging an end of the motor to the bracket and connecting the wiring from the motor to bracket with male and female electrical connector(s).

A secondary objective of the present invention is to provide devices, apparatus, systems and methods of hanging ceiling fans, which allows for the wiring connections to easily, occur while the ceiling fan mounting bracket is installed.

A third objective of the present invention is to provide devices, apparatus, systems and methods of allowing the ceiling fan installer to perform all of the wiring for installation before the heavy part of the ceiling fan has to be lifted into place, which makes the installation easier, faster and safer for the installer.

A fourth objective of the present invention is to provide devices, apparatus, systems and methods of allowing the ceiling fan installer to perform all of the wiring for installation without having to perform the wiring when the ceiling motor is in the way of the installation, which makes the installation easier, faster and safer for the installer.

A fifth objective of the present invention is to provide devices, apparatus, systems and methods of allowing wiring connections between the ceiling fan mount bracket and ceiling mount to occur while the ceiling fan mounting bracket is installed, which allows for the bulky, heavy ceiling fan motor to be left safely at ground level, while wiring is occurring. When the ceiling fan motor is securely in the mounting bracket, the male connector from the motor can be mateably interlocked with the female connector from the mounting bracket.

A sixth objective of the present invention is to provide devices, apparatus, systems and methods of wiring connections between the ceiling fan mount bracket and ceiling fan to occur while the ceiling fan mounting bracket is installed, with interlocking wire connectors mateably attachable to one another between the fan motor and the mounting bracket, and excess loose wiring is looped about brackets on the mounting bracket.

The invention allows for the ceiling fan installer to attach the hanger bracket with a female connector attached to a home wiring. The ceiling fan can then be installed into the mounting bracket, followed by a mateable male connector from the motor mateably interlocking with the female connector. No other interim step is needed such as holding or hanging the fan motor out of way to wire the fan motor to the hanger bracket.

The invention allows for the ceiling fan installer to perform all of the wiring before the heavy part of the ceiling fan has to be lifted into place, which makes the installation easier, faster and safer for the installer.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
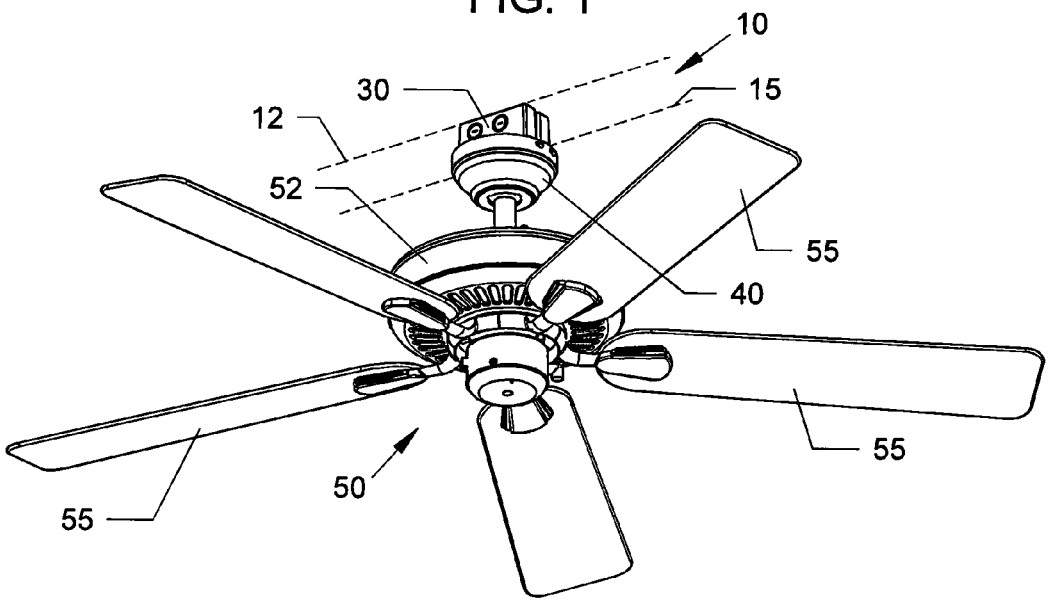
FIG. 1 is a bottom perspective view of a ceiling fan secured to an electrical utility box by the motor being mounted to a mounting bracket.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10. Ceiling fan with easy connect hanger installed.
12. joist
15. Ceiling surface.
20. Mounting bracket.
22. c shaped flange
30. Outlet box. Part of the homes electrical system.
40. Bracket (canopy) shroud.
50. Fan assembly.
52. Fan motor
55. Fan blades.
60. Motor hanging rod.
70. Motor mounting ferrule.
80. House wiring coming out of outlet box.
90. Wire nut.
100. Mounting bracket harness. Part of the mounting bracket.
111. Male locking tab.
112 Contact pins in male connector.
113 Male locking step.
110. Male connector. Terminates one end of the mounting bracket harness and is secured to the mounting bracket.
120. Mounting screws. Used to secure mounting bracket to outlet box.
121. openings in bracket
125. threaded sockets in ceiling junction box
130. Fan motor wiring harness. Emerges from top of motor hanging rod and is terminated with a female connector that will mate to the mounting bracket harness connector.
135. Female connector. Terminates one end of the fan motor wiring harness.
136. Female locking bridge.
137. Locking surface of bridge.
138. Contact pins in female connector.
139. Locking ramp. Pushes locking tab away from connector which helps to lock male locking step against locking surface of female locking bridge.
140. Harness support hooks. These are a part of the mounting bracket and are used as a reel to wrap the excess length of the fan wiring harness around so that it can be easily managed allowing for easy installation of the bracket shroud.
150. Harness support bracket. This is a part of the mounting bracket and is used to contain and manage the excess length of the fan wiring harness.

FIG. 1 is a bottom perspective view of a ceiling fan 10 secured to an electrical utility (outlet) box 30 by the ceiling fan motor 52 with fan assembly 50 being mounted by a support rod 60 to a mounting bracket 20. The fan assembly 50 further includes fan blades 55 attached to the motor 52. A shroud (canopy) 40 covers the mounting bracket 20 underneath. The shroud (canopy) 40 with mounting bracket 20 is attached to a ceiling junction box 30 which is usually attached to joists 12 behind a ceiling 15.

Figure 2:
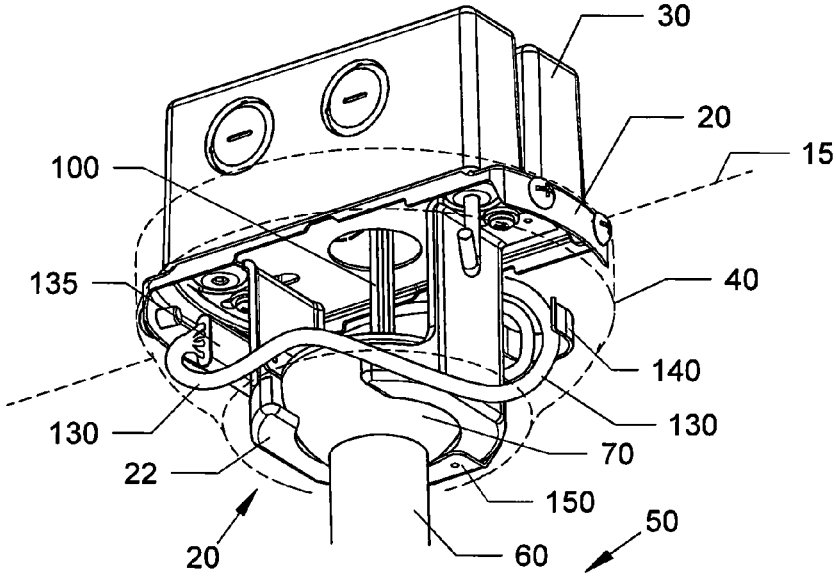
FIG. 2 is an enlarged view of the bracket with rod to motor supported thereon attached to the electrical junction box in the ceiling.

FIG. 2 is an enlarged view of the mounting bracket 20 with motor mounting ferrule 70 on support 60 rod, where the ferrule 70 is hung on c shaped flange 22 on the bottom of the mounting bracket 20. Here, the ceiling fan assembly 50 is supported by support rod 60 and ferrule 70 to the mounting bracket 20 which is attached to the electrical junction box 30 in the ceiling 15. Here, the fan motor wiring harness 130 with female connector 135 is wrapped about support hooks 140 and held by harness support bracket 150.

Figure 4:
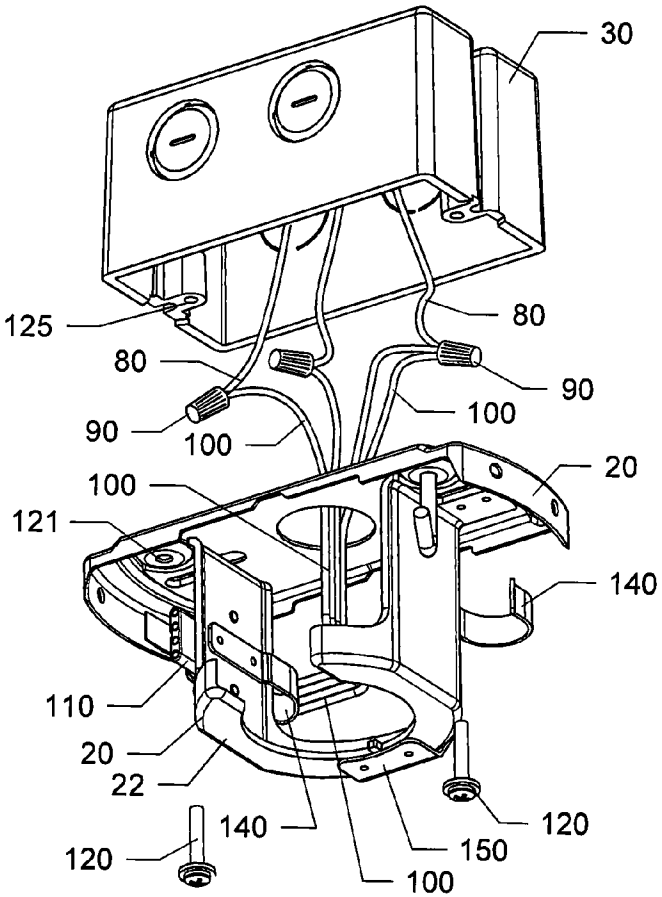
FIG. 4 shows the mounting bracket electrically attached to the junction box, and ready to be mechanically attached to one another.
Figure 3:
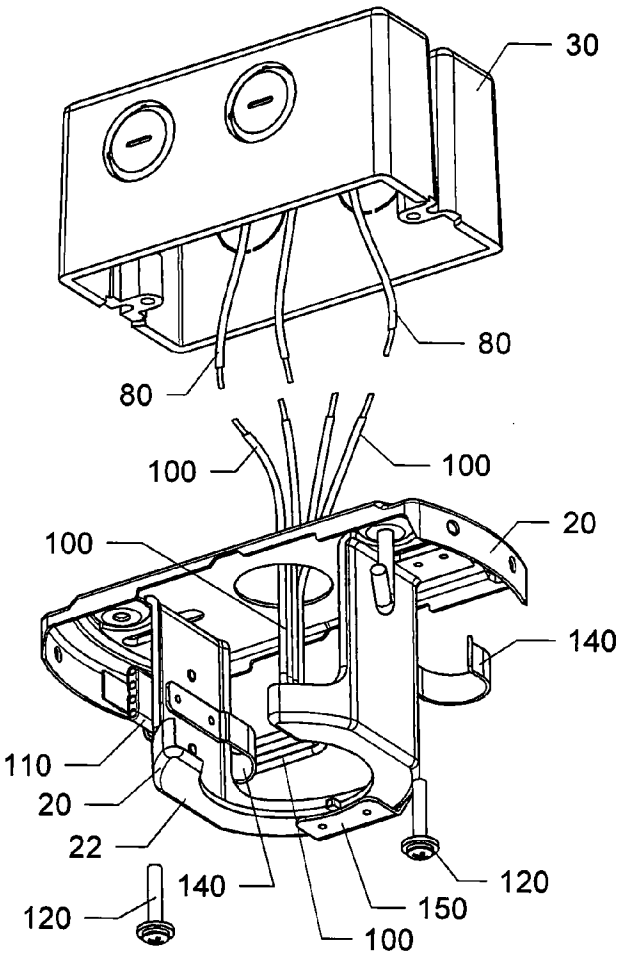
FIG. 3 is an exploded view of the mounting bracket spaced apart from the ceiling electrical junction box depicted in FIG. 2.

FIG. 3 is an exploded view of the mounting bracket 20 spaced apart from the ceiling electrical junction box 30 depicted in FIG. 2. FIG. 4 shows the mounting bracket 20 electrically attached to the junction box 30, and ready to be mechanically attached to one another. The installer can take the wire ends of the mounting bracket harness 100 which can be twisted about the outer ends of the house wiring 80. Next, wire nuts 90 can be tightened over the twisted ends to form the electrical connection between the ceiling junction box 30 and the mounting bracket 20. The mounting bracket 20 can be mechanically attached to the ceiling junction box 30 by mounting screws 120 which can pass through openings 121 in the mounting bracket 20 and into threaded sockets 125 in the ceiling junction box 30. The male connector 110 and the harness support hooks 140 are shown and will be explained in more detail later.

Figure 5:
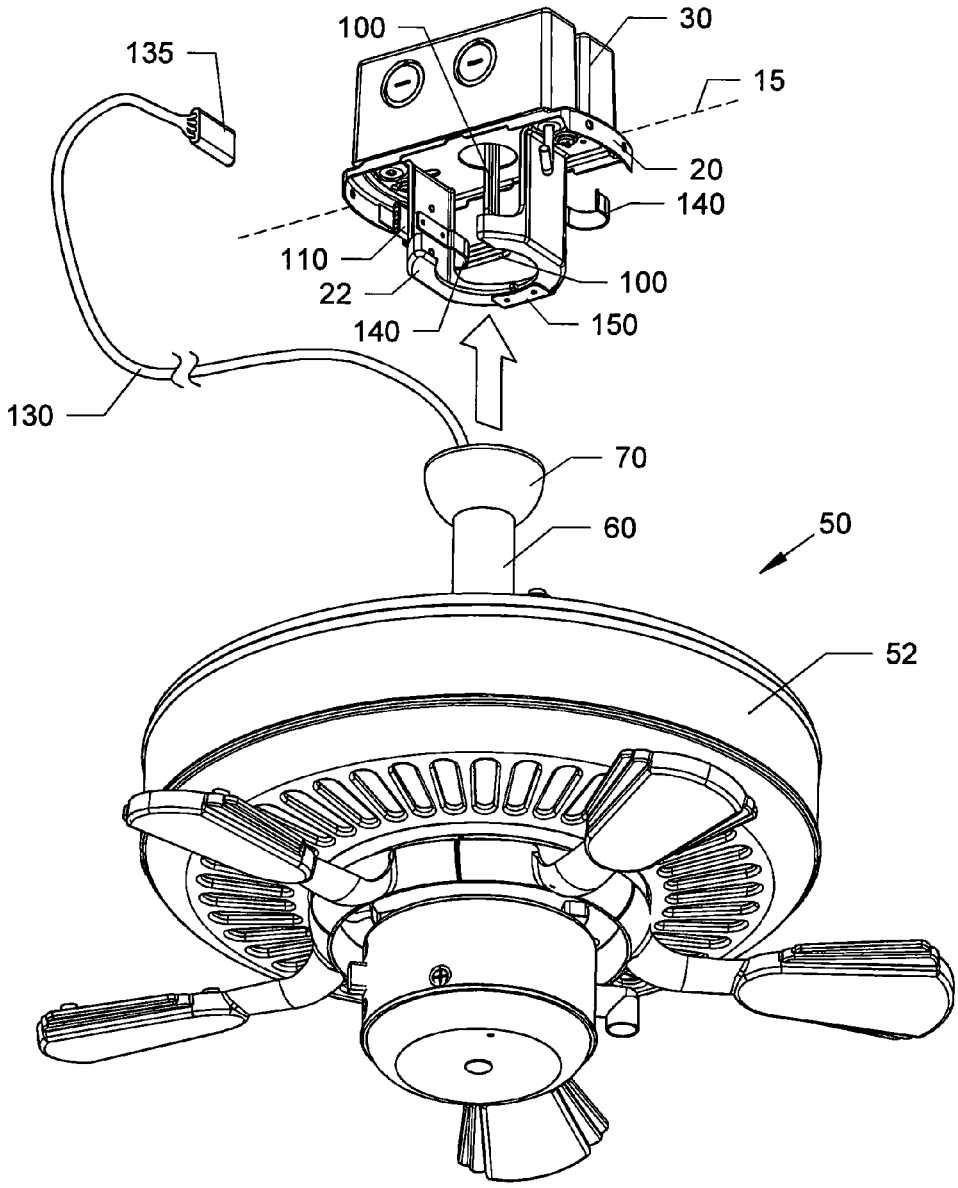
FIG. 5 is an exploded view of the ceiling fan motor with support rod spaced from the ceiling junction box with attached mounting bracket of FIG. 4.

FIG. 5 is an exploded view of the ceiling fan assembly 50 and motor 52 with support rod 60 and ferrule 70 spaced apart from the ceiling junction box 30 with attached mounting bracket 20 of FIG. 4. The installer pre-attaches the mounting bracket 20 to the ceiling fan junction box 30. Next, the installer lifts the ceiling fan assembly 50 so that the ferrule 70 is hung by the c shaped flange 22 of the bracket 20.

Figure 6:
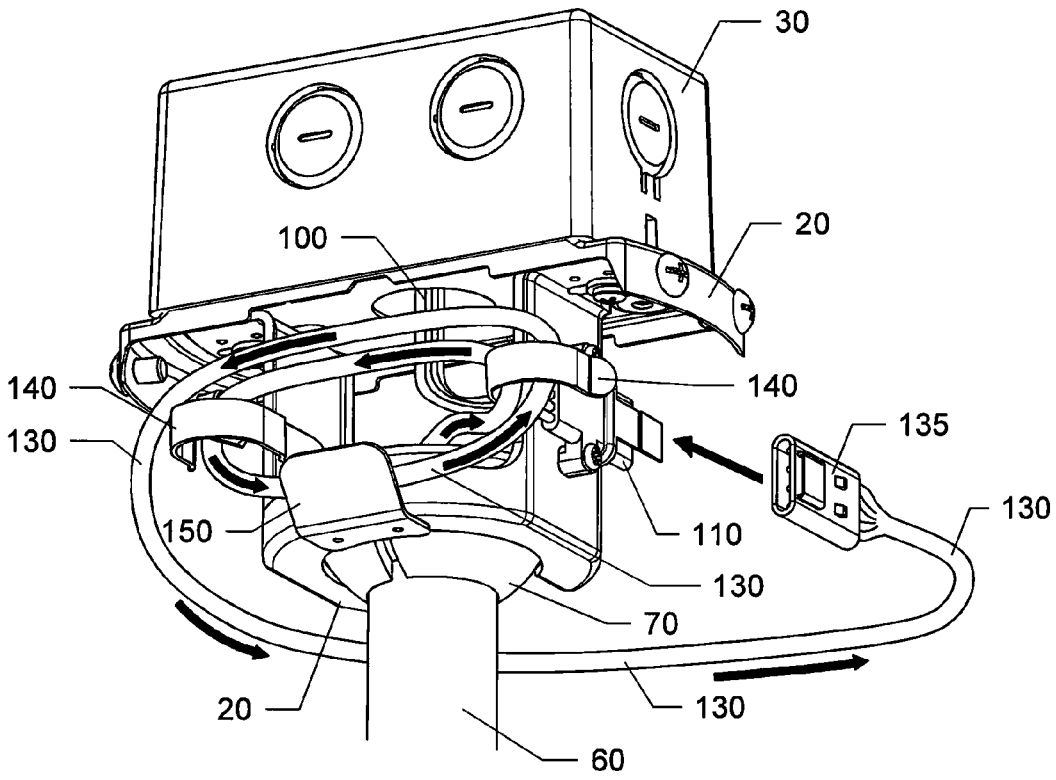
FIG. 6 is a perspective view of the upper part of the support rod for the ceiling fan motor of FIG. 5 hanging from the mounting bracket which has been attached to the ceiling junction box with the male and female electrical couplers separated from one another.

FIG. 6 is a perspective view of the upper part of the support rod 60 for the ceiling fan assembly 50 with motor 52 of FIG. 5 hanging from the mounting bracket 20 which has been attached to the ceiling junction box 30 with the male electrical connector 110 and female electrical coupler 135 separated from one another.

Figure 6A:
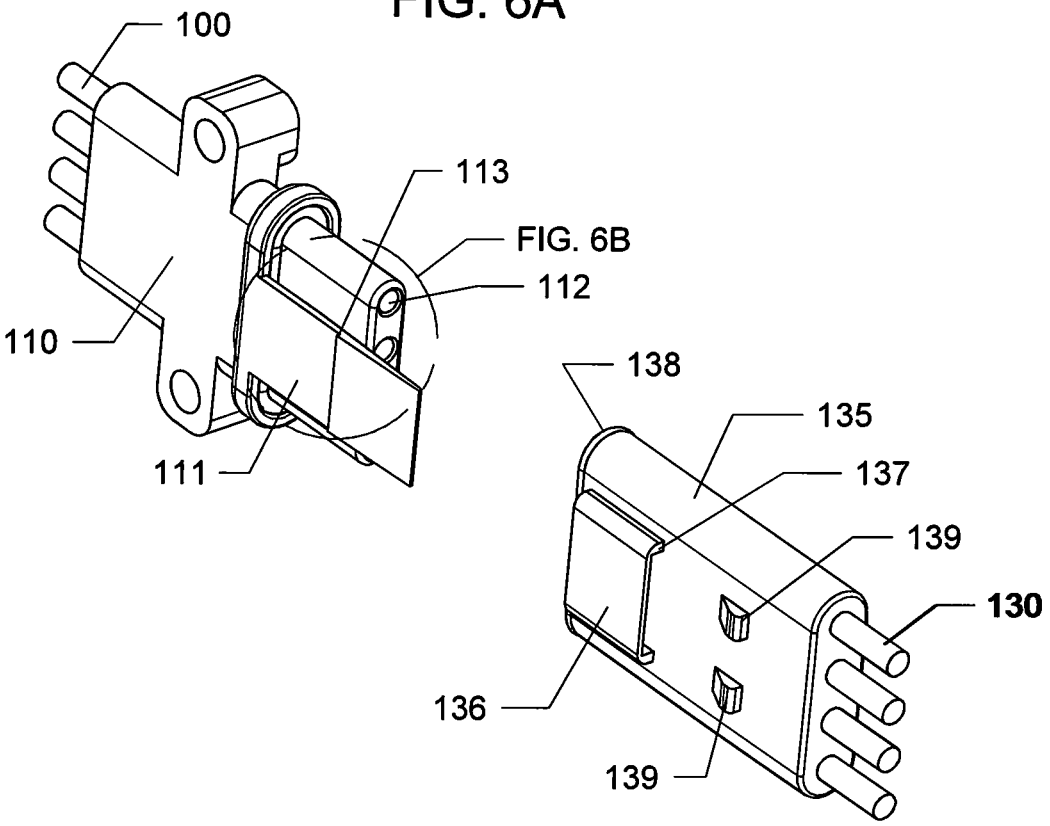
FIG. 6A is an enlarged view of the male and female interlocking electrical couplers between the ceiling fan motor and the mounting bracket of FIG. 6.

FIG. 6A is an enlarged view of the male and female interlocking electrical couplers 110, 135 between the ceiling fan assembly 50 with motor 52 and the mounting bracket 20 of FIG. 6. Female electrical connector 135 includes contact pins 138 (not shown) that are similar to contact pins 112 of the male connector 110. Female connector 135 includes female locking bridge 136 with locking ramp portions 139 on the side of the connector 135, and fan motor wiring harness 130 extending therefrom.

Figure 6B:
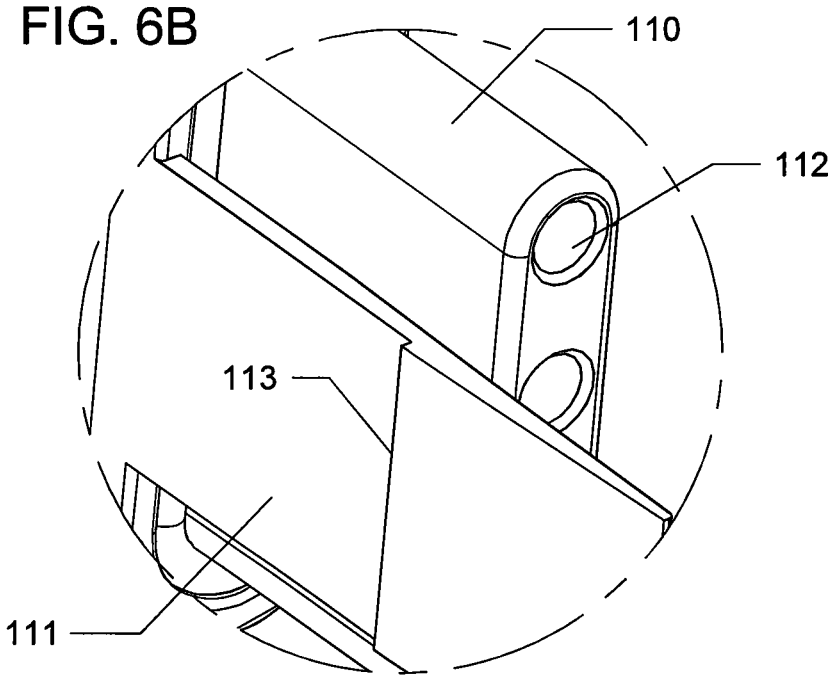
FIG. 6B is an enlarged view of the male electrical connector of FIG. 6A.

FIG. 6B is an enlarged view of the male electrical connector 110 of FIG. 6A with contact pins 112, male locking tab 111 having male locking step 113.

Figure 6C:
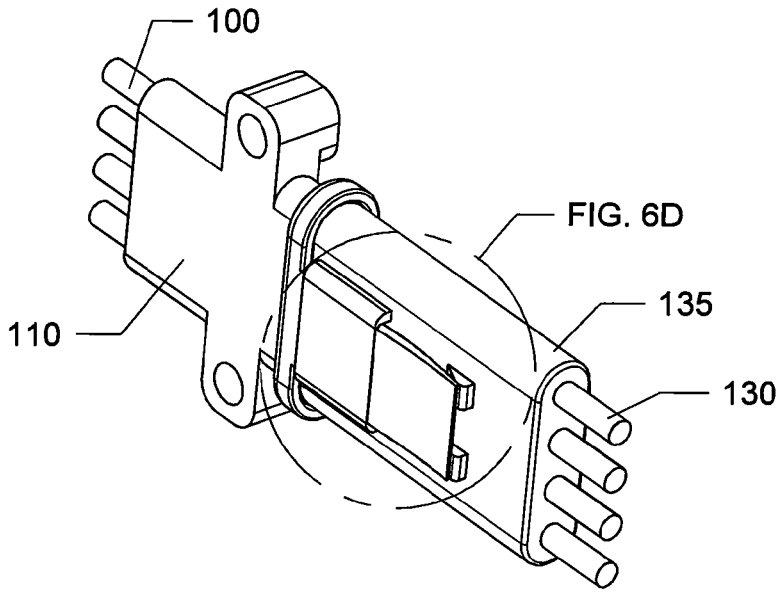
FIG. 6C shows the male and female interlocking electrical couplers of FIG. 6A interlocked with one another.
Figure 6D:
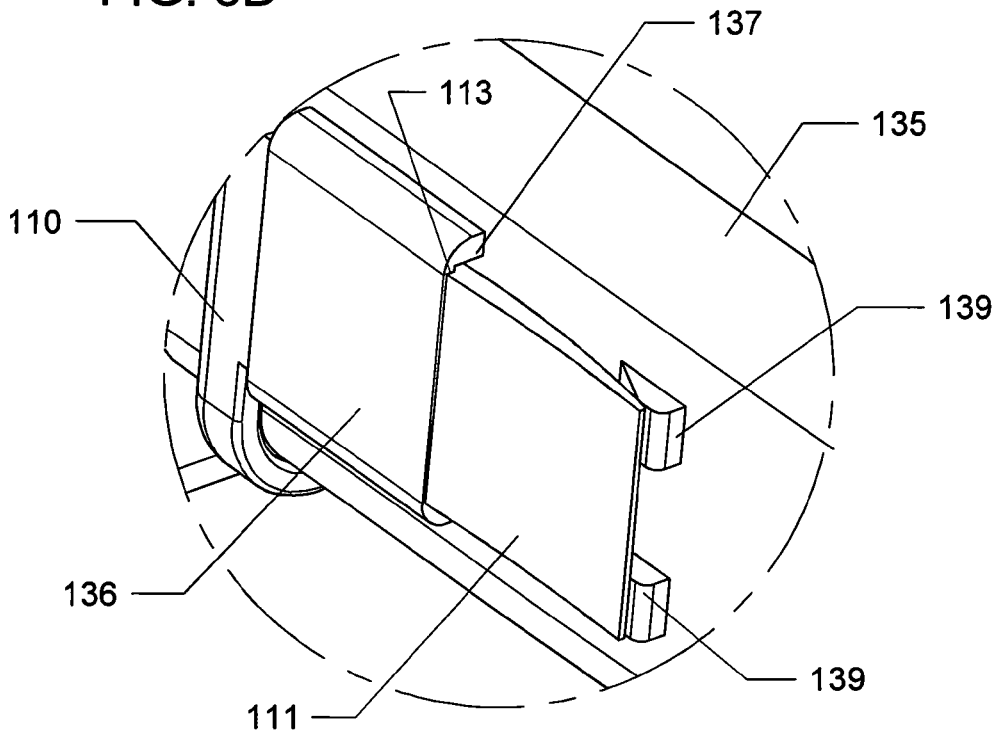
FIG. 6D is an enlarged view of the locking tab and locking bridge of FIG. 6C.

FIG. 6C shows the male and female interlocking electrical couplers 110, 135 of FIG. 6A interlocked with one another. FIG. 6D is an enlarged view of the locking tab 111 with step 113 abutting against locking surface 137 of locking bridge 136 of FIG. 6C, with the ends of the tab 111 resting on angled side portions of locking ramp 139.

Figure 7:
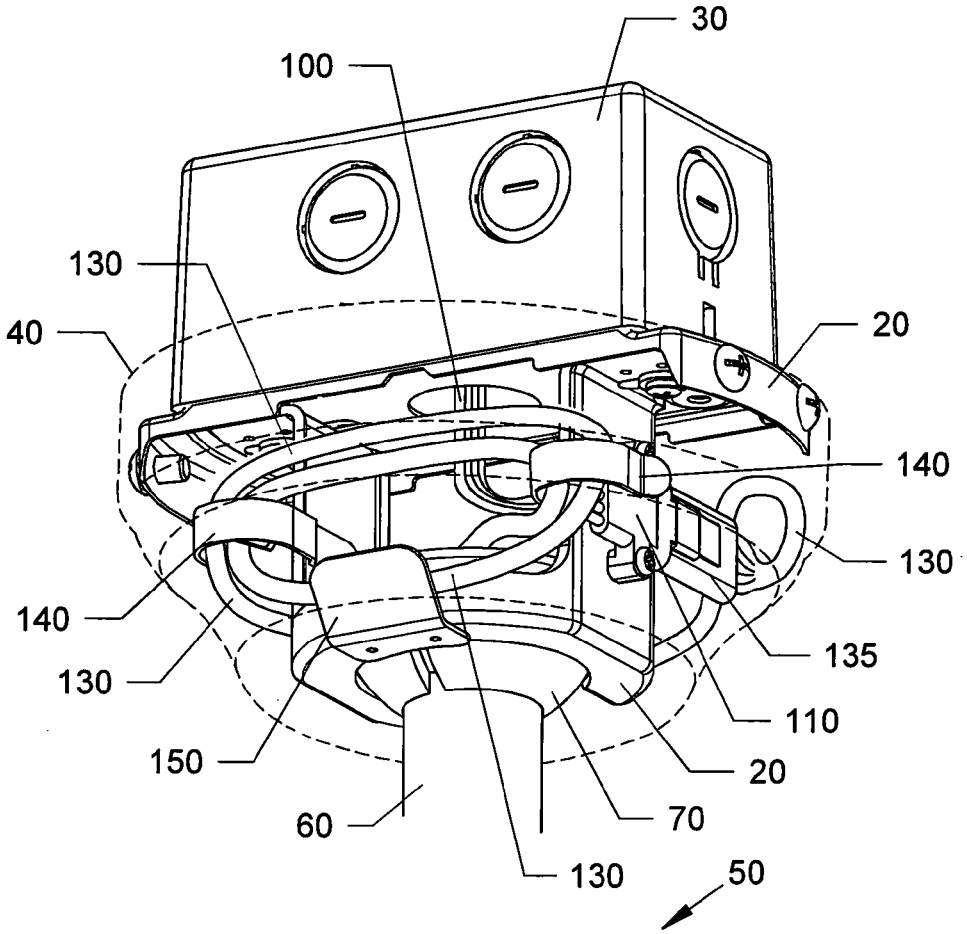
FIG. 7 is a perspective view of the motor with support rod hanging from the bracket with the male and female connectors interlocked in FIG. 6 with one another and excess loose wiring wrapped about opposite facing hooks and supported by a harness support bracket.

FIG. 7 is a perspective view of the ceiling fan assembly 50 with support rod 60 and ferrule 70 hanging from the bracket 20 with the male and female connectors 110, 135 interlocked from FIG. 6 with one another and excess loose wiring 130 wrapped about opposite facing hooks 140 and supported by a harness support bracket 150. The opposite facing hooks 140 allow for any excess and loose wiring to be wrapped around the hooks 140 and held in place, with the bracket 150 supporting and raising the loose and excess loose wiring 130.

Although the embodiment shows the female connector is shown on the mounting bracket and the male connector is on the motor, the invention can be practiced with the male connector on the mounting bracket and the female connector on the motor.

While the embodiment shows using male and female connectors to attach the motor wiring to the bracket wiring, the invention can be practiced with other types of easy to attach wiring coupling, such as but not limited to wiring fasteners that snap with one another, and the like.

Although the embodiment shows only attaching the mounting bracket wiring to the motor wiring with male and female attachment fasteners, the invention can allow for attaching the ceiling mount wiring to the motor mount bracket wiring using male and female wire coupler fasteners.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method of hanging ceiling fans with safe electrical connections, comprising the steps of:

providing a ceiling mount box attached within a ceiling;

providing a fan mounting bracket having a top, a bottom and sides, the fan mounting bracket with wiring having one end connected to a power supply and another end having a first interlocking fastener;

attaching the top of the fan mounting bracket to the ceiling mount box with the fan mounting bracket mounted underneath the ceiling;

providing a ceiling fan motor with a support and wiring having one end attached to the motor and an opposite end having a second interlocking fastener;

hanging the fan motor by the support to the fan mounting bracket;

electrically connecting the fan mounting bracket to the motor by interlocking the first interlocking fastener into the second interlocking fastener, wherein the motor is electrically connected to the wiring from the fan mounting bracket, without using wire nuts;

providing a pair of J shaped hooks extending in one direction from the sides of the fan mounting bracket, the J shaped hooks having openings facing in opposite directions from each other;

wrapping loose wiring about the J shaped hooks;

providing a harness support bracket on the bottom of the fan mounting bracket located between and below the J shaped hooks; and supporting the loose wiring by the harness support bracket.

2. The method of claim 1, wherein the first interlocking fastener and the second interlocking fastener are selected from male and female electrical connectors which mateably attach to one another.

3. The method of claim 1, wherein the step of attaching the fan mounting bracket to the ceiling mount box includes the step of:

electrically connecting wiring from the power supply through the ceiling mount box to an input wiring end in the fan mounting bracket, by interlocking additional electrical fasteners together.

4. The method of claim 3, wherein the step of electrically connecting the wiring from the power supply to the input wiring end, includes the step of:

interlocking the additional electrical fasteners together with male and female electrical connectors which mateably attach to one another.

5. A system for electrically connecting ceiling fan motors to mounting brackets without using wire nuts, comprising:

a ceiling fan motor with support and a first interlocking wiring end;

a mount bracket having a top, a bottom and sides, the top of the mount bracket is adapted to be attached to a bottom of a ceiling electrical box that is mounted within a ceiling so that the mount bracket is located below the ceiling, the mount bracket is electrically wired to the electrical box by wiring while the ceiling fan motor remains spaced apart and not electrically connected therefrom, and the mount bracket having a second interlocking wiring end;

a hanger for hanging the fan motor from the mount bracket;

an electrical connection between the motor and the mount bracket, formed by interlocking the first interlocking wiring end to the second interlocking wiring end, without using wire nuts; and a pair of J shaped hooks extending in one direction from the sides of the mount bracket, the J shaped hooks having openings facing in opposite directions from each other, wherein loose wiring is wrapped about the J shaped hooks; and a harness support bracket on the bottom of the ceiling fan mount bracket located between and below the shaped hooks for supporting the loose wiring thereon.

6. The system of claim 5, wherein the first interlocking wiring end and the second interlocking wiring end are selected from male and female electrical connectors which mateably attach to one another.

7. A system for wiring ceiling fans during installation, comprising:

a fan mounting bracket with wiring having one end connected to a power supply and another end having a first interlocking fastener, the fan mounting bracket having a top, a bottom and sides, wherein the top of the fan mounting bracket is adapted to be attached to a ceiling mount box attached within a ceiling so that the fan mounting bracket is below the ceiling;

a ceiling fan motor with a support and wiring having one end attached to the motor and an opposite end having a second interlocking fastener, wherein the motor is hung from the fan mounting bracket, wherein the first interlocking fastener and the second interlocking fastener are selected from male and female electrical connectors which mateably attach to one another;

an electrical connection formed between the fan mounting bracket to the motor, formed by interlocking the first interlocking fastener into the second interlocking fastener, so that the motor is electrically connected to the wiring from the fan mounting bracket, without using wire nuts;

an electrical connection between the wiring from the power supply through a ceiling mount to an input wiring end in the fan mounting bracket, the wiring connection formed by interlocking additional electrical fasteners together, wherein the additional electrical fasteners include male and female electrical connectors which mateably attach to one another;

a pair of J shaped hooks extending in one direction from the sides of the fan mounting bracket, the J shaped hooks having openings facing in opposite directions from each other, wherein loose wiring is wrapped about the J shaped hooks; and a harness support bracket on the bottom of the ceiling fan mount bracket located between and below the J shaped hooks for supporting the loose wiring thereon.

* * * * *